US012595150B2

(12) United States Patent
Oldorff et al.

(10) Patent No.: US 12,595,150 B2
(45) Date of Patent: Apr. 7, 2026

(54) METHOD FOR PRODUCING A PACKAGING

(71) Applicant: SWISS KRONO Tec AG, Lucerne (CH)

(72) Inventors: Frank Oldorff, Schwerin (DE); Sebastian Dicke, Bantikow (DE)

(73) Assignee: SWISS KRONO Tec AG, Lucerne (CH)

( * ) Notice: Subject to any disclaimer, the term of this patent is extended or adjusted under 35 U.S.C. 154(b) by 289 days.

(21) Appl. No.: 18/016,547

(22) PCT Filed: Jun. 14, 2021

(86) PCT No.: PCT/EP2021/065953
§ 371 (c)(1),
(2) Date: Jan. 17, 2023

(87) PCT Pub. No.: WO2022/017683
PCT Pub. Date: Jan. 27, 2022

(65) Prior Publication Data

US 2023/0278825 A1 Sep. 7, 2023

(30) Foreign Application Priority Data

Jul. 20, 2020 (EP) ..... 20186771

(51) Int. Cl.
*B65H 37/00* (2006.01)
*B65H 18/16* (2006.01)

(52) U.S. Cl.
CPC ..... *B65H 37/00* (2013.01); *B65H 18/16* (2013.01); *B65H 2301/514* (2013.01); *B65H 2301/5162* (2013.01)

(58) Field of Classification Search
CPC .. B65H 37/00; B65H 18/16; B65H 2301/514; B65H 2301/5162; B65H 18/28;
(Continued)

(56) References Cited

U.S. PATENT DOCUMENTS 1,989,183 A * 1/1935 Blake ..... B65D 85/671 206/414
2,615,564 A * 10/1952 Post ..... B65D 85/672 206/493

(Continued)

FOREIGN PATENT DOCUMENTS

CN 210149924 U 3/2020
EP 0655389 5/1995

(Continued)

OTHER PUBLICATIONS

International Search Report issued on Sep. 9, 2021 in corresponding Application No. PCT/EP2021/065953; 6 pages.

(Continued)

*Primary Examiner* — Anna K Kinsaul
*Assistant Examiner* — Mobeen Ahmed
(74) *Attorney, Agent, or Firm* — Andrew M. Calderon; Calderon Safran & Wright P.C.

(57) ABSTRACT

The disclosure relates to a method for producing a circumferential packaging for a paper roll. The paper roll has a wound paper web and two opposing end faces and a circumferential surface that connected the end faces to each other. The method includes the following steps: applying a protective material in liquid form to an end section of the paper web by at least one application unit, the protective material being applied to one of two sides of the end section of the paper web, winding up the end section of the paper web, so that the end section forms at least one outer layer of the paper roll, and curing the protective material, resulting in a protective layer that covers the circumferential surface.

19 Claims, 4 Drawing Sheets

(58) Field of Classification Search
CPC .... B65H 2301/5113; B65H 2301/5114; B65H 2801/81; B65H 2801/84; B65B 25/148
See application file for complete search history.

(56) References Cited

U.S. PATENT DOCUMENTS

| | | | | | |
|---|---|---|---|---|---|
| 2,746,224 | A * | 5/1956 | Wollett | B65B 25/148 | 53/372.8 |
| 2,803,935 | A * | 8/1957 | Marold | B65B 25/148 | 53/461 |
| 3,165,432 | A * | 1/1965 | Plaskett | B32B 27/00 | 156/244.21 |
| 3,895,748 | A * | 7/1975 | Klingenberg | F16K 23/00 | 141/117 |
| 3,924,375 | A * | 12/1975 | Brenner | B65B 25/148 | 53/372.9 |
| 3,929,226 | A * | 12/1975 | Nijs | B65D 85/671 | 206/415 |
| 4,062,447 | A * | 12/1977 | Gardner | B65D 85/672 | 206/493 |
| 4,137,690 | A * | 2/1979 | Morgan | B65B 25/148 | 53/372.9 |
| 4,407,690 | A * | 10/1983 | White | B29C 48/305 | 427/361 |
| 4,574,021 | A * | 3/1986 | Endres | B32B 27/10 | 156/247 |
| 4,608,807 | A * | 9/1986 | Skripalle | B65B 63/04 | 53/118 |
| 4,716,709 | A * | 1/1988 | Lamb, Sr. | B65B 25/148 | 53/399 |
| 5,007,538 | A * | 4/1991 | Mushinski | B65B 25/148 | 206/412 |
| 5,016,430 | A * | 5/1991 | Itoh | B65B 25/148 | 53/370.2 |
| 5,114,012 | A * | 5/1992 | Mushinski | B65B 25/148 | 206/412 |
| 5,265,399 | A * | 11/1993 | Niskanen | B65B 25/148 | 53/136.2 |
| 5,310,058 | A * | 5/1994 | Hannen | B65D 85/672 | 206/415 |
| 5,548,942 | A | 8/1996 | Zajec | | |
| 5,761,881 | A * | 6/1998 | Wall | B65B 25/148 | 53/136.2 |
| 6,186,326 | B1 * | 2/2001 | Pienta | B65B 25/148 | 53/399 |
| 6,342,297 | B1 * | 1/2002 | LaBrash | C09J 101/28 | 428/355 R |
| 6,458,448 | B1 | 10/2002 | Hunt | | |
| 6,505,459 | B1 * | 1/2003 | Ruohio | B65B 25/148 | 53/372.9 |
| 7,238,236 | B2 * | 7/2007 | Wilks | B65H 19/29 | 118/325 |
| 2002/0033350 | A1 * | 3/2002 | Itkonen | B65B 25/148 | 206/410 |
| 2002/0192406 | A1 * | 12/2002 | Labbe | B65B 25/148 | 53/465 |
| 2003/0115835 | A1 * | 6/2003 | Kadota | B65B 25/148 | 53/442 |
| 2004/0096483 | A1 * | 5/2004 | Wilks | B65H 19/29 | 424/443 |
| 2007/0295628 | A1 * | 12/2007 | Uitenbroek | B65B 25/148 | 206/413 |
| 2013/0008816 | A1 * | 1/2013 | Aumais | B32B 27/08 | 53/461 |
| 2013/0341225 | A1 * | 12/2013 | Risler | B65D 85/00 | 206/413 |
| 2014/0014711 | A1 * | 1/2014 | Jutras | B65D 65/10 | 229/87.01 |
| 2016/0297603 | A1 * | 10/2016 | Mongrain | D21H 27/10 | |
| 2023/0278825 | A1 * | 9/2023 | Oldorff | B65H 37/00 | |

FOREIGN PATENT DOCUMENTS

| | | | | |
|---|---|---|---|---|
| EP | 2151388 | | 2/2010 | |
| JP | 2000019686 | A | 1/2000 | |
| TW | 200932996 | A * | 8/2009 | B32B 29/00 |

OTHER PUBLICATIONS

Notice of First Examination Opinion in corresponding Chinese Patent Application No. 202180059902.0 on Mar. 26, 2025, 16 pages.

* cited by examiner

METHOD FOR PRODUCING A PACKAGING

FIELD OF THE INVENTION

The invention relates to a method for producing a wrapping for a circumferential paper roll. It also relates to a method for producing an end side packaging for a paper roll as well as a method for producing a packaging for a paper roll. In each case, the paper roll has a wound paper web and two opposing end sides and a circumferential surface that connects the end sides to one another.

BACKGROUND OF THE INVENTION

Such paper rolls have been known from the prior art for many years and are used, for example, in the paper and printing industry. They can be provided blank, for example as raw paper rolls, or printed as paper rolls. They are usually used to transport long paper webs, which can be several kilometres long, from a production location to another location, where they are further processed. To ensure that the paper rolls are not damaged during transport, they must be packaged and protected. To this end, the paper rolls are usually removed from their production facility, so that their end sides can be accessed axle-free. Handling of the rolls is complex and requires large machines, as each roll can weigh up to 1.5 t.

The packaging is packaged in a separate packaging machine, which can be operated automatically or semi-automatically. In individual cases, paper rolls are also packaged manually. The packaging is usually composed of a circumferential packaging which serves to protect the circumferential surface of the paper roll. The packaging usually also comprises two end face packagings.

The circumferential packaging is traditionally made of two layers of brown paper with a grammage of 100 g/square meter, for example, wherein a waterproof layer, for example a polyurethane layer, can be arranged between the two paper layers. It is applied, for example, with a grammage of 20 g/square meter. Alternatively, a circumferential packaging may also be provided in the form of a foil that is placed around the paper roll to protect it from external influences, especially moisture. Of course, the foil can also be strengthened with a reinforcement layer, for example made of cardboard, to achieve mechanical stability and protect the paper layer against impacts and bumps, for example. An end face packaging is traditionally used in the form of a coated cardboard cover, the diameter of which at least approximately, but preferably completely, corresponds to the diameter of the paper roll. Such an end cover protects the end faces of the paper roll against external influences. An end cap either has a fold-down edge protector itself, for example because the diameter of the end cover is greater than the diameter of the paper roll to be packaged. In this case, the end cover projects above it and can be folded down. The folded down part then forms the edge protector. Alternatively, a separate edge protector is used that is bonded at the transition from end cover to circumferential packaging.

Methods for packaging paper rolls are complex. A separate packaging machine is usually required or the paper roll has to be manually packaged on a reel splicer or its shaft of the production machine on which the paper web is processed and then rolled up, especially a printing machine. This requires additional staff. In addition, due to the separate packaging material, one is dependent on suppliers, requires storage space and additional financial expenditure.

SUMMARY

The invention is therefore based on the task of improving methods for packaging a paper roll in such a way that they are quick, easy and cost-effective to carry out whilst still ensuring effective and secure packaging of the paper roll.

The invention solves the addressed task by way of a method for producing a circumferential packaging for a paper roll, the paper roll having a wound paper web and two opposing end faces and a circumferential surface that connects the end sides to each other, the method comprising the following steps:

- applying a protective material in liquid form to an end section of the paper web,
- winding up the end section of the paper web, so that the end section forms at least one outer layer of the paper roll, and
- curing the protective material, thereby creating a protective layer that covers the circumferential layer.

The method according to the invention can be carried out, for example, in the production facility, i.e. in particular within a printing line, in which the paper roll is produced, i.e. the paper web is processed and rolled up. For this purpose, preferably only one additional application unit is used by which the protective material can be applied in liquid form to the paper web, especially to the end section of the paper web. This can be an anilox roller with a scoop tray, for example, from which the protective material is scooped with the anilox roller. To avoid excessive material application, a scraper can be provided that removes excess protective material from the anilox roller. In this embodiment of the method, the anilox roller preferably applies the protective material onto an application roller, such as a rubber roller, which then applies the protective material to the end area of the paper web. Alternatively, the application unit is, for example, a print head, such as a digital printing facility, a coating unit or a laminating facility.

The protective material is applied in liquid form and preferably exhibits protective, especially water-repellent, properties in the cured state. Wax, resin or plastic, such as polyurethane (PU) or polyethylene (PE) can be used as protective material. The protective material can be pigmented or dyed in order to take individual requirements and preferences into account. The protective material can also be multi-colored, so that protective material of different colors can be applied to different points of the end section, for example. This opens up more visual design options. This is especially advantageous for the protective material that is applied to the part of the end section that is visible from the outside once the protective material has been cured. Labels or bar/QR codes can be applied in this area by using differently colored protective material. This is especially easy to achieve when the at least one application unit is a digital printing unit. The application quantity of the protective material is preferably at least 3 g/square meter, preferably at least 5 g/square meter, especially preferably at least 8 g/square meter and at most 50 g/square meter, preferably at most 30 g/square meter, especially preferably at most 15 g/square meter.

The protective material can be applied to one side of the end section of the paper web or to both sides of the end section of the paper web, i.e. to an upper side and a lower side of the paper web. With at least one sensor and an electronic control unit, it can be monitored that the desired application quantity of protective material is applied; in this way, the desired distribution of the protective material can also be monitored.

Given that the protective material is directly applied to the paper web in an application unit, it is not necessary to reduce the production speed of the production facility, for example of the printing line. This saves on time. An additional printing unit can be arranged downstream of the application unit to allow information, for example about the content of the paper roll, a delivery location or other information, to be printed onto the protective material, which has preferably already been cured. The at least one application unit can be a digital application unit or an analogue application unit.

Preferably, the application of the protective material is monitored by at least one sensor, preferably by means of multiple sensors. The result is preferably used to identify and correct possible deviations from a predetermined target application quantity. In addition, the monitoring result is preferably stored, especially preferably electronically. This renders it possible to trace, in the event of subsequent problems or complaints, whether sufficient protective material was used.

Advantageously, the end section is so long that it forms multiple outer layers of the paper roll when it is wound up, preferably at least three outer layers, especially preferably at least five outer layers, especially preferably at least seven outer layers. The more outer layers of the paper roll the end section forms, the better the protection of the underlying paper. Preferably, the length of the end section is at least 3 m, especially at least 5 m, especially preferably at least 8 m and at most 100 m, preferably at most 40 m, especially preferably at most 20 m. When the paper web is wound up on the shaft or a hub, each revolution of the shaft results in one layer of paper being wound up on the shaft. For example, after 100 revolutions of the shaft, there are 100 layers of paper of the paper web on the shaft. 100 layers then lie on top of each other.

Advantageously, a mark is applied to the paper web that forms the start of the end section. This mark can preferably be processed electronically once it has been automatically detected, for example optically by a camera. An electric or electronic control unit of the facility detects the mark and generates a control signal with which the application unit for the protective material is controlled, so that the protective material can be applied to the end section of the paper web that is designated by the mark.

Preferably, the protective material is cured before the end section is wound up. To this end, the paper of the paper web coated in the protective material is preferably guided through a drying facility or a curing facility. Depending on the protective material, the coated paper can be irradiated with infrared light, UV radiation, heat or other radiation to accelerate the curing. Within the scope of the present invention, cross-linking or polymerization of the protective material is also understood to be a curing. If the protective material is cured before winding up, it is especially easy to print onto the cured protective material.

Alternatively, the end section is wound up before the protective material is fully cured, so that the protective material preferably joins multiple outer layers of the paper roll formed by the end section during the curing process. This does not result in multiple separate layers coated in cured material; rather, the protective material of different layers bonds during curing, cross-linking or polymerization and forms a single thicker and therefore more secure protective layer.

The invention also solves the addressed task by way of a method for producing an end face packaging for a paper roll, the paper roll having a paper web wound on a shaft and two opposing end faces and a circumferential surface that connected the end faces to each other, the method comprising the following steps:

providing an end cover that has a base body with an opening and a tab for covering the opening, arranging the end cover on the shaft in such a way that the end cover rests on an end side of the paper roll and the shaft extends through the opening, removing the paper roll from the shaft and covering the opening with the tab.

During production of a paper roll, a paper web, which may be several kilometers long, is wound up on a shaft. This shaft is mounted on at least one end side of the paper roll, but preferably on both sides of the paper roll. As a result, the large forces, resulting on the one hand from the large mass of the paper roll and the high rotation speeds of the paper roll during winding on the other, are absorbed. However, in this state it is not possible to package the entire end side of the paper roll as the shaft protrudes from the end side.

The method according to the invention for producing an end side packaging renders production considerably easier. An end cover is used which, for example, has been produced on a paper basis and preferably contains a cardboard that is coated with a coating, especially a waterproof coating. Such a coating may be produced, for example, from a polyurethane (PU) or a polyethylene (PE). In this context, a tab is understood to mean a flat element that covers the opening in the end cover.

The end cover is preferably at least almost, but preferably exactly, circular and, in a first embodiment, features an opening that is punched, for example. Before the paper web is rolled up, such an end cover is put on the shaft by guiding the shaft, onto which the paper web is to be wound, through the opening. Preferably, two such end covers are put on the shaft, the paper web then being wound between the two end covers, resulting in the paper roll.

Alternatively, the end cover has an indentation in which its shape deviates from that of a circle. Advantageously, the indentation extends radially inwards from the edge of the end cover. Particularly preferably, the indentation extends beyond the center point of the circular cover.

In a further embodiment, the opening is a hole through which the shaft can be inserted and which is connected to the edge of the end cover by a cut. This cut preferably replaces the indentation.

Such an end cover is now slid onto the shaft, on which the paper roll is mounted, until the shaft extends through the indentation. To this end, part of the end cover may have to be turned down, folded or expanded, for example when the opening is a hole and the indentation is just a cut that extends from the outer edge of the end cover to the hole. Particularly preferably, the shaft then extends through the center point of the end cover. In this state, a large part of the end side of the paper roll is already covered and protected by the end cover. Only part of the end side remains accessible from the outside through the indentation of the end cover and therefore unprotected. After the paper roll is removed from the shaft, the shaft no longer protrudes beyond the end side of the paper roll and the remaining part of the end side of the paper roll can be covered and protected. To this end, the indentation of the end cover is covered by the tab of the end cover.

In a further embodiment, the cover has two cover halves that are arranged in such a way that a hole forms between them, through which the shaft extends in the arranged state.

The cover halves are preferably identical, so that two cover halves can be put together to form a base body. Of course, differently designed cover halves can be used, which together form a base body.

The tab of the end cover can be designed as a separate element and preferably made of the same material or the same material combination as the rest of the end cover. It is preferably slightly larger than the opening in the base body of the end cover it is to cover, so that the edge of the tab can be connected, for example bonded, with the edge of the indentation.

Alternatively, the tab and the base body are designed as a single piece. Preferably, the tab is connected to the base body along a parting line across at least part of its circumference, said parting line preferably having a perforation, wherein the tab preferably has to be separated from the base body along this parting line before the end cover is slid onto the shaft. In an advantageous embodiment, the parting line forms the border between base body and tab, thereby forming the opening of the base body.

The end cover can be provided as a single piece, the tab and the base body having not yet been separated along the parting line. In this state, the end cover is preferably circular in shape. If the end cover is now to be arranged on the shaft, the tab is separated from the base body along the parting line, which is rendered especially easy by the perforation preferably provided. This creates the opening, preferably the indentation, into which the shaft can be inserted. It has been proven especially advantageous for the tab to remain connected to the base body of the end cover, even after separating it along the parting line. In this case, the parting line therefore does not extend across the entire circumference of the tab, but only across part of it. The tab can then be separated from the base body of the end cover along the parting line and, for example, turned down, the folding line corresponding to the connection line between base body and tab.

In this embodiment, once the paper roll has been removed from the shaft, only the turned down part, i.e. the tab, has to be folded back up. It is then reconnected to the base body of the end cover along the parting line, so that the opening is completely covered by the tab.

Advantageously, the tab has a first part for covering a first part of the indentation and a second part for covering a second part of the indentation, the first part of the indentation being covered by the first part of the tab before the paper roll is removed from the shaft. The two parts of the tab preferably abut each other in the radial direction. Here, the first part is arranged radially on the outside and the second part radially on the inside. The two parts can preferably be separated from each other by a second parting line, which may also have a perforation. In this embodiment, preferably only the tab is separated from the base body along the first parting line before the end cover is slid onto the shaft. Once the end cover has been slid onto the shaft, the second parting line is separated between the two parts of the tab and the first part of the tab, located radially on the outside, can be turned down. The first part of the tab is then preferably reconnected with the base body of the end cover along the part of the first parting line that extends along this part of the tab, so that the first part of the indentation is covered and the thus covered part of the paper roll is protected. In this state, the end cover therefore features the indentation, through which the shaft extends. Once the paper roll has been removed from the shaft, the second part of the tab is also turned down to cover the second part of the indentation.

The width of the indentation, i.e. its extension in the circumferential direction, preferably corresponds to the diameter of the shaft.

Preferably, the base body and the tab are made from a paper material or cardboard material coated in a protective material.

The invention also solves the addressed task by way of a method for producing a packaging for a paper roll, the paper roll having a wound paper web and two opposing end faces and a circumferential surface that connected the end faces to each other, the method comprising the following steps:

- producing a circumferential packaging according to a method described here,
- producing at least one end side packaging according to a method described here and
- connecting the at least one end side packaging to the circumferential packaging.

Preferably, two end side packagings are produced for each one of the two end sides of the paper roll. Each of these two end side packagings is connected to the circumferential packaging, so that the paper roll is completely packaged and protected against external influences.

The protective material used for the circumferential packaging and the protective material used for the end side packaging are preferably identical.

In an advantageous embodiment, a diameter of at least one end cover, preferably of all end covers, is greater than the diameter of the paper roll. In this case, part of the end cover is turned down onto the circumferential packaging to connect the end side packaging to the circumferential packaging. This renders a separate edge protection element unnecessary and further reduces the complexity of the machines required. However, an additional edge protection element can of course be used to provide even more protection for the sensitive edges of the paper roll, especially against mechanical stress from outside.

Therefore, an edge protector is preferably applied along the edges of the paper roll along which the circumferential surface adjoins the end sides after the circumferential packaging has been connected to the at least one end side packaging or to connect the circumferential packaging to the end side packaging. The second alternative is particularly advantageous if the diameter of the end side packaging is not greater or not sufficiently greater than the diameter of the paper roll.

The invention also solves the addressed task by way of a device for carrying out a method described here for producing a circumferential packaging, a device for carrying out a method described here for producing an end side packaging and/or a device for carrying out a method described here for producing a packaging for a paper roll.

The working width of a digital printing system is preferably at least 1300 mm, preferably at least 1900 mm, particularly preferably at least 2000 mm and at most 2300 mm, preferably at most 2200 mm and particularly preferably at most 2100 mm. The speed of the system at which the surface to be printed is moved through the system is preferably at least 80 m/min, preferably at least 120 m/min and particularly preferably at least 130 m/min and at most 270 m/min, preferably at most 150 m/min and particularly preferably at most 140 m/min when printing on paper. If a primer is applied to the surface to be printed, the applied quantity is preferably at least 1 $g/m^2$, preferably at least 2 $g/m^2$ and especially preferably at least 3 $g/m^2$ and at most 10 $g/m^2$, preferably at most 6 $g/m^2$, especially preferably at most 4 $g/m^2$.

In a first specific embodiment example, a wooden decor was produced on a paper digital printing system with a working width of 2070 mm and a speed of 135 m/min on a white decor paper with 65 g/square meter CRYK water-based ink with an inline primer application of approx. 3 g/square meter. The printing system had an additional application unit with a ceramic anilox roller, a scoop tray and a scraper with a scoop volume of approximately 8 g/square meter. This application unit was arranged in the direction of production behind a drying facility in which the digital print applied was dried by means of irradiation with NIR radiation (NIR: near infrared). The application medium applied in the application unit contained PE components as well as brown color pigments. The production order was for 10,000 linear meters. At the point of the paper web corresponding to the ten thousandth linear meter, a flag was automatically placed by a labeling machine. This flag was detected by machine, so that the additional application unit for coating with the PE protective material was switched on without having to stop the entire system.

In this example, the printed end section was 20 m long and was coated with approximately 8 g/square meter PE coating, which was then dried in a drying facility before winding. The applicable protective material was also irradiated with NIR radiation and dried in this drying unit. In addition, a small digital printing unit was used, which was arranged in the direction of production behind the application unit and printed various packaging-relevant information, such as a barcode, onto the protective material. After winding, a waterproof circumferential packaging formed, which was several layers thick. A 7-layer packaging layer was created on the roll diameter of about 90 cm with a circumference of about 280 cm. A conventional circumferential packaging according to the prior art has a grammage of approximately 220 g/square meter. The packaging produced here has a grammage of approximately 511 g/square meter, composed of 7 layers of a paper coated with 8 g/square meter that weighs 65 g/square meter. Due to the brown color pigments contained in the protective material, the outer color of the packaging produced resembles conventional cardboard. The packaging-relevant information, preferably printed in black, were clearly legible. The roll diameter was measured with a laser at 90 cm. An end cover with a diameter of 85 cm and a folding tab was selected. The tab was turned down and the end cover slid onto the shaft. The first part of the tab in the area of the outer diameter of the roll, i.e. radially outside, was folded shut again, an edge protection tape was applied and taped all around with waterproof tape. The roll was removed from the reel splicer. The remaining open second parts of the respective tabs in the area of the axles were subsequently folded shut and also taped with waterproof adhesive tape.

The roll was then delivered to an impregnation channel for further processing. The end section coated with the protective material, which forms the circumferential packaging, was used for clamping in the impregnation channel. This saved 20 m of printed decorative paper.

In a second specific embodiment, water-based ink was applied to a 70 g/square meter decorative paper in beige using three ink form rollers on a rotogravure press with a working width of 2070 mm and a speed of 300 m per minute to produce a wooden ceiling. An application unit was arranged in the printing system after the third applied color was dried. Said application unit has a ceramic anilox roller, a scoop tray and a scraper with a scoop volume of approximately 15 g/square meter. The protective material applied contained PE components. The production order was for 17,000 linear meters. At the seventeen thousandth linear meter, a flag was automatically placed by a labeling machine, said flag being detected by machine. As a result, the application unit was automatically switched on for the application of the protective material without the need to stop the entire system. The coated end section was 50 m long and coated with approximately 15 g/square meter of the protective material, which contains PE components. The protective material was then dried without a separate drying facility before winding, but the protective material was not completely dried. During winding, the layers cross-linked or bonded together to form a waterproof circumferential package. A 13-layer packaging layer was created on a roll diameter of about 116 cm with a circumference of about 365 cm. It has a grammage of approximately 1105 g/square meter, composed of 13 layers of a paper with 70 g/square meter and a surface coating of approximately 15 g/square meter.

An end cover with a diameter of 115 cm and a folding tab was selected. The tab was was unfolded and the end cover slid over the shaft of the roll winder. The first part of the tab, which is located radially on the outside, was folded shut again, an edge protection tape was applied and taped with waterproof adhesive tape. The roll was then removed from the shaft. The remaining open second parts of the tabs in the area of the shaft were subsequently folded shut and taped with waterproof adhesive tape. This roll was also delivered to an impregnation channel for further processing, wherein the coated end area of the paper web was used for clamping purposes. This saved 40 m of printed decorative paper.

In a third specific embodiment example, a wooden decor was produced on a paper digital printing system with a working width of 2070 mm and a speed of 135 m/min on a white decor paper with 65 g/square meter CRYK water-based ink with an inline primer application of approx. 4 g/square meter. In the printing system, a digital application unit was used for the bulk application of the protective material, which was arranged in the direction of production behind a drying facility for the ink applied. The printing heads of the application unit had a resolution of 30 dpi. They extended across the entire working width. The application side, to which the protective material is applied, corresponded to the print side. The protective material contained resin components and yellow color pigments. The production order was for 4000 linear meters. At the four thousandth linear meter, a flag was automatically placed by a labeling machine, said flag being detected by machine, and the application unit was automatically switched on for the application of the protective material without the need to stop the entire system. The coated end section was approximately 30 m long and coated with approximately 10 g/square meter of the protective material. Before winding, the protective material was dried with an air drying facility. A small digital printing device, arranged behind the application unit in the direction of production, printed packaging-relevant information and barcodes onto the protective material in the last meter of the end section.

After winding, a waterproof circumferential packaging formed, which was several layers thick. A 16-layer packaging layer formed on a roll diameter of about 58 cm with a circumference of about 182 cm. It has a grammage of approximately 1200 g/square meter, composed of 16 layers of a paper with 65 g/square meter that was coated with approximately 10 g/square meter. The roll diameter was manually measured at 58 cm. An end cover with a diameter of 50 cm and a folding tab was selected. The tab was turned down and the end cover slid onto the shaft. The first part of the tab, located radially on the outside, was folded shut again, an edge protection tape was applied and taped all around with waterproof adhesive tape. The roll was then removed from the shaft. The respective second part of the tab was then folded shut and also taped with waterproof adhesive tape. This roll was also delivered to an impregnation channel for further processing, wherein the coated end area of the paper web was used for clamping purposes. This saved 30 m of printed decorative paper.

BRIEF DESCRIPTION OF THE DRAWINGS

In the following, a number of embodiment examples of the invention will be explained in more detail with the aid of the accompanying figures. They show FIG. 1—the schematic representation of a device for producing a circumferential packaging, FIG. 2—the schematic sectional view through a paper roll according to an embodiment example of the present invention, FIG. 3—the schematic sectional view through a paper roll according to a further embodiment example of the present invention, FIGS. 4 to 9—schematic representations of different steps in the method for producing an end side packaging, FIG. 10—the schematic representation of an end cover, FIG. 11—the schematic representation of a further end cover and FIG. 12—the schematic representation of the edge of an end cover.

DETAILED DESCRIPTION OF INVENTION

Figure 1:
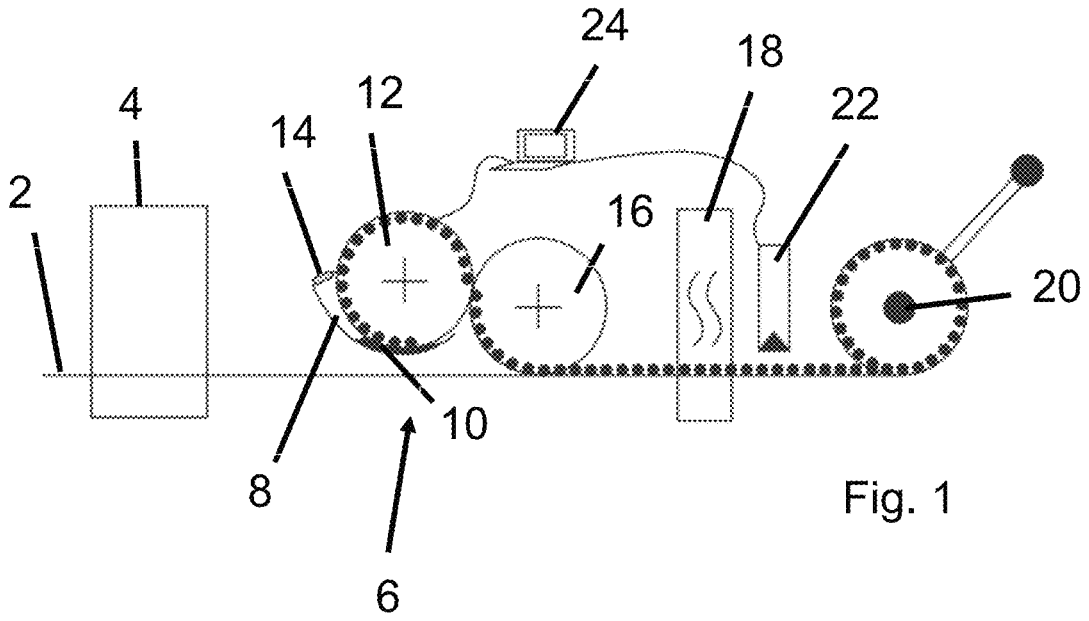

FIG. 1 schematically depicts part of a device for producing a circumferential packaging according to a first embodiment example of the present invention. A paper web 2 passes through a drying facility 4 in which, for example, a color application applied to the paper web 2 is dried. The paper web 2 subsequently passes through an application device 6 that comprises a scooping tray 8 containing a protective material 10. An anilox roller 12 scoops protective material 10 out of the scooping tray 8. A scraper 14 removes excess protective material 10 from the anilox roller 12. The anilox roller 12 transfers the protective material 10 to an application roller 16, which applies it to the paper web 2. In the embodiment example shown, the paper web 2 with the protective material 10 passes through a second drying facility 18 in which the protective material 10 is dried before the paper web 2 processed in this way is wound onto a shaft 20 of a roll winder. The application of the protective material 10 is monitored via sensors 22 connected to an electronic control unit 24.

Figure 2:
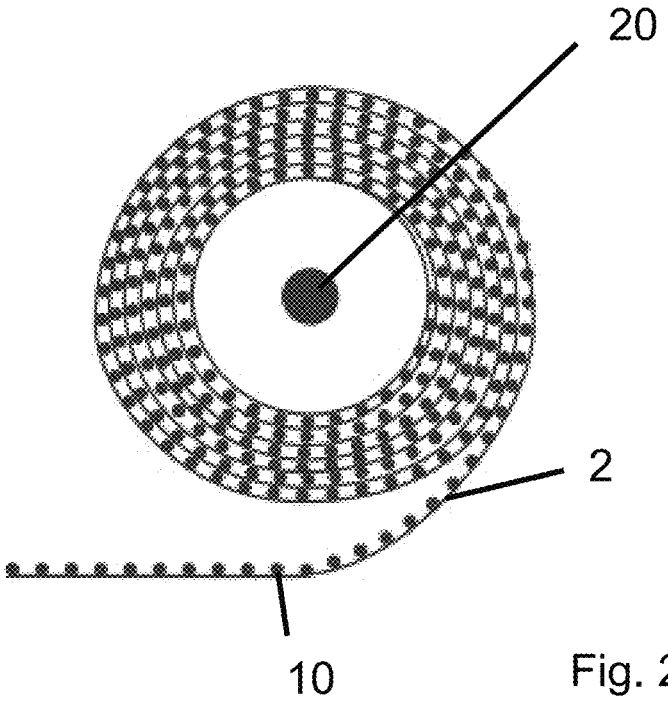

FIG. 2 schematically shows how the material of the paper web 2 coated with the protective material 10 is wound onto the shaft 20. Radially inwards is a white area by which it is represented that a large part of the paper web 2 is already wound up, which has not been coated with the protective material 10. In the embodiment example shown in FIG. 2 the protective material 10 is completely cured before the end area of the paper web 2, which was coated with the protective material 10, is wound up. As depicted in FIG. 2, this results in seven separate layers of paper of the paper web 2 that are coated with the protective material 10.

Figure 3:
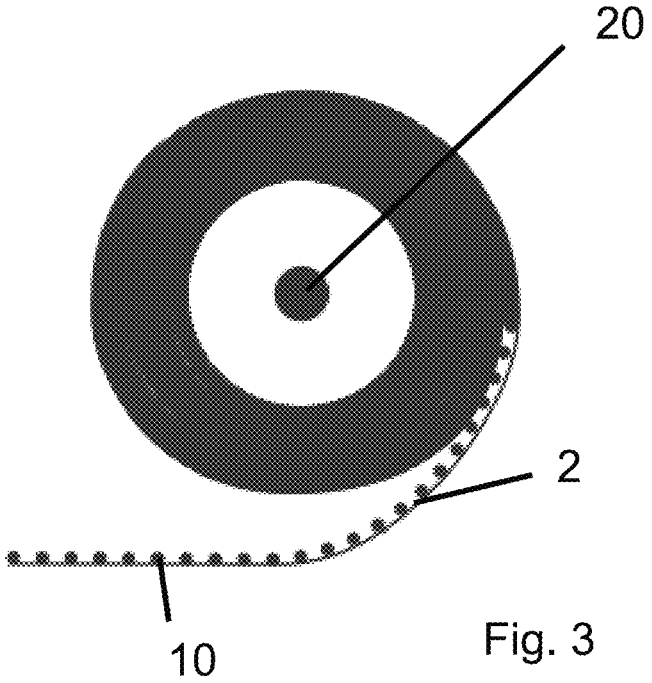

FIG. 3 depicts another embodiment. In this case too, the protective material 10 has been applied to the paper web 2. However, it has not been completely dried, so that the various layers of the paper web 2 that were coated with the protective material 10 and are now wound up are bonded to create a single protective layer, as the protective material 10 of the different layers bonds together. Unlike in FIG. 2, this results in a single protective layer, while in FIG. 2 seven separate protective layers are created.

Figure 4:
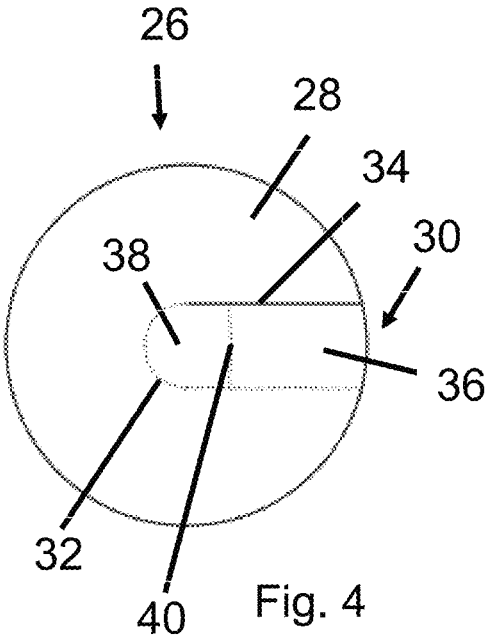

FIGS. 4 to 9 schematically depict different phases of a method in which an end side packaging is to be produced. FIG. 4 shows an end cover 26. It has a base body 28 designed as a single piece with a tab 30. A first parting line 32, designed as a perforation, extends across part of the circumference of the tab 30. A folding line 34 extends across a second part of the circumference of the tab 30. In the embodiment example shown in FIG. 4, the tab 30 has a first part 36 and a second part 38, which are separated from each other by a second parting line 40.

Figure 5:
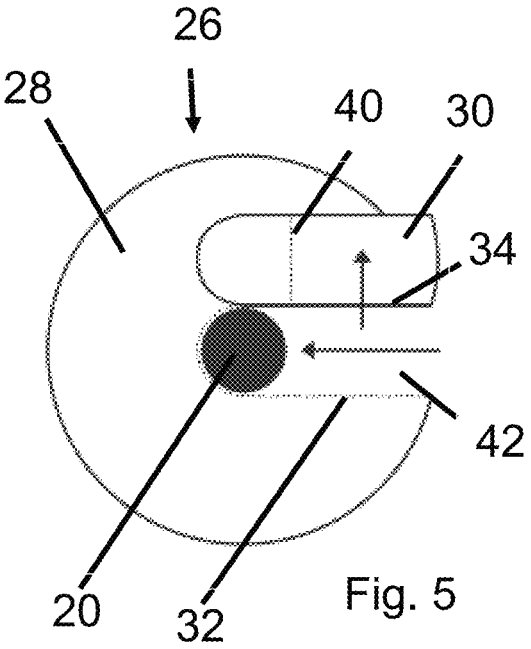

FIG. 5 shows that the tab 30 has been separated from the base body 28 of the end cover 26 along the first parting line 32 and folded upwards along the folding line 34. An indentation 42 forms, so that the end cover 26 can be slid onto the shaft 20. In the embodiment example shown, the second parting line 40 is intact in this step of the method and the two parts 36, 38 of the tab 30 have not yet been separated from each other.

Figure 6:
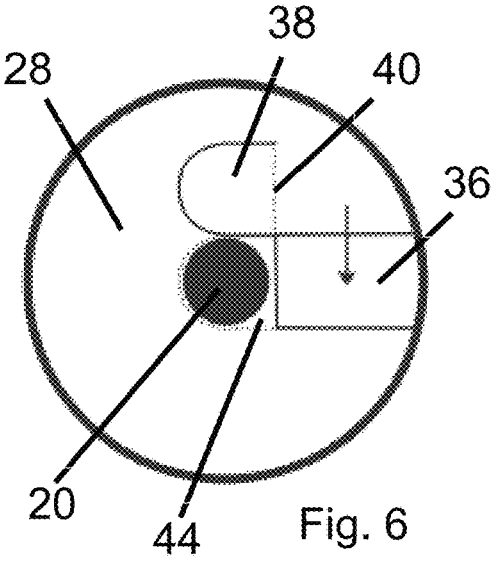

This changes in FIG. 6. The first part 36 and the second part 38 of the tab 30 are separated from each other along the second parting line 40. The first part 36 of the tab 30 is then turned down, so that only one opening 44 remains open, through which the shaft 20 extends. The first part 36 of the tab 30 is bonded to the base body 28 of the end cover 26.

Figure 7:
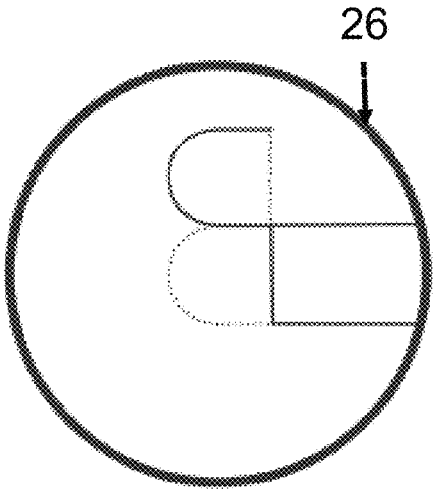
Figure 8:
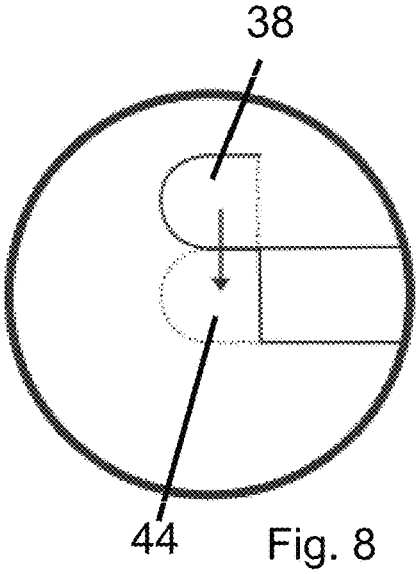
Figure 9:
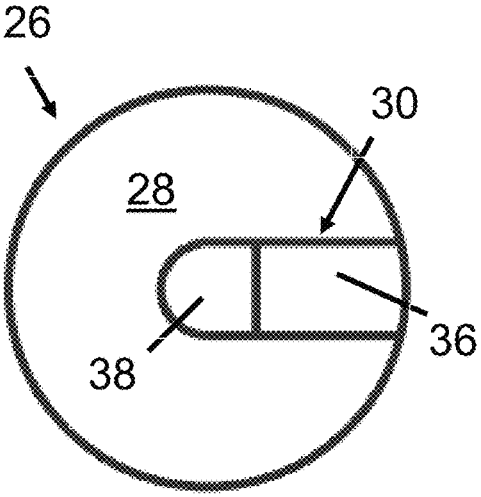

As shown in FIG. 7, the paper roll with the paper cover 26 depicted in FIG. 7 is then removed from the shaft 20. According to FIG. 8, the second part 38 of the tab is then also folded downwards and the opening 44 as the second part of the indentation 42 closed. FIG. 9 depicts the completely closed end side packaging in which both the first part 36 and the second part 38 of the tab 30 are bonded to the base body 28 of the end cover 26.

Figure 10:
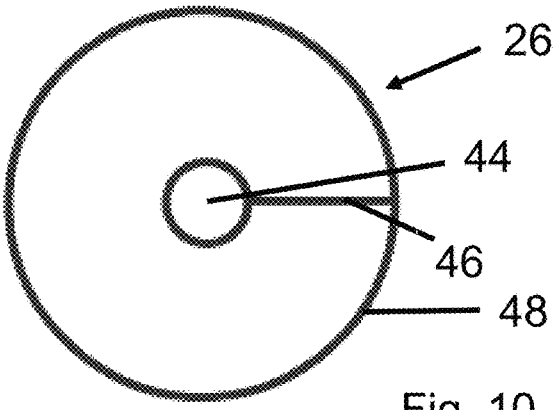

FIG. 10 schematically shows a further embodiment of an end cover 26. The opening 44 is designed in the form of a hole that is large enough to accommodate the shaft 20, which is not shown in FIG. 10. To be able to slide the end cover 26 onto the shaft 20, the end cover 26 features a cut 46 that extends from the outer edge 48 of the end cover 26 to the opening 44. The material of the end cover 26 is designed to be so flexible that it does not require a folding line in order to unfold the end cover 26 along the cut 46 and slide it onto the shaft.

Figure 11:
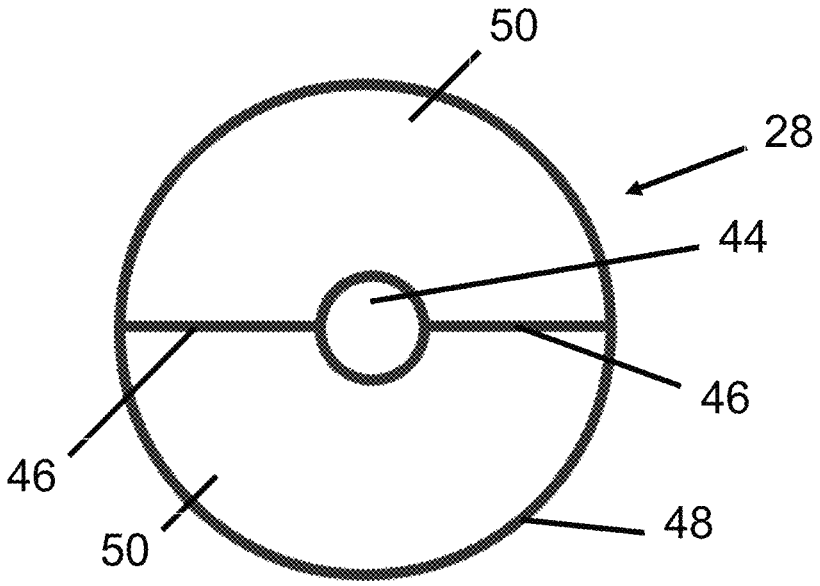

FIG. 11 shows the base body 28 of an end cover 26. The base body 28 comprises two cover halves 50. In the middle of them is the opening 44, through which the shaft 20, not depicted, extends when the end cover 26 is in the mounted state. The cut 46 is located between the two cover halves 50, said cut now extending from the central opening 44 to the outer edge 48 of the base body 28 of the end cover 26. In the embodiment example shown in FIG. 11, the two cover halves 50 are designed to be identical. This is advantageous, but not essential. The two cuts 46 do not necessarily have to be opposite each other and symmetrical to the center of the opening 44.

Figure 12:
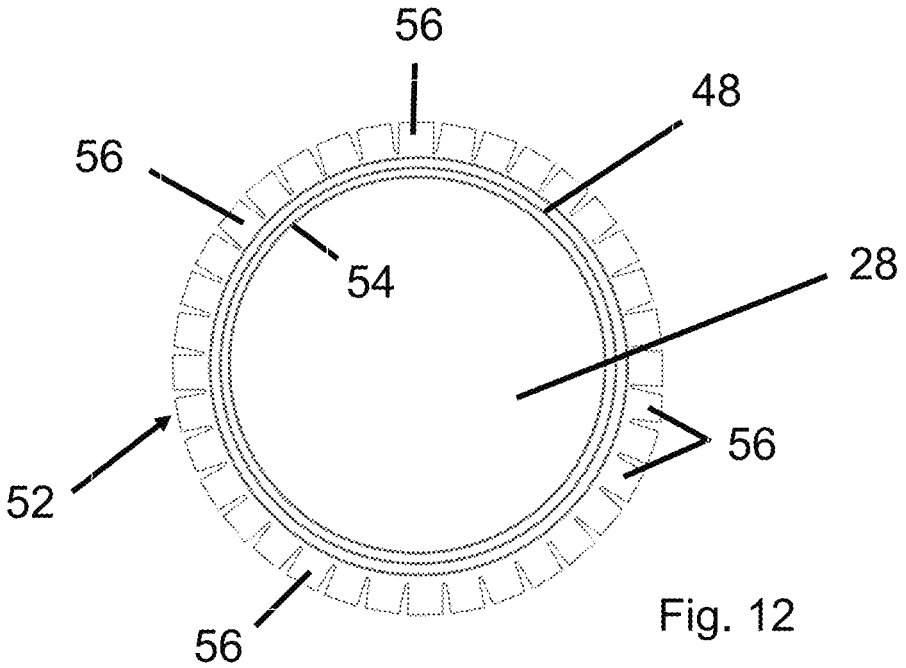

FIG. 12 schematically depicts a base body 28 of an end cover 26, the representation of the specific design of the base body 28 having been omitted. FIG. 12 illustrates the outer edge 48 of the base body 28, on which an edge protector 52 is located. In the embodiment example shown, it features a fastening ring 54 by which the edge protector 52 is fixed, for example stuck, to the base body 28 of the end cover 26. The edge protector 52 has a plurality of folding tabs 56, which are distributed equidistantly across the circumference in the embodiment example shown. This is advantageous, but not essential. An irregular arrangement of the folding tabs 56 is also possible. They project beyond the outer edge 48 of the base body 28 and are used to connect the end side packaging, achieved through the end cover 26, to a circumferential packaging. To this end, the folding tabs 56 are turned down and fixed, for example stuck, to the circumferential packaging.

The invention claimed is:

1. A method for producing a circumferential packaging for a paper roll, the circumferential packaging and paper roll is formed from a single paper web, the paper roll having two opposing end faces and a circumferential surface that connects the end faces to each other, the method comprising the steps:

applying a protective material in liquid form to an end section of the paper web by at least one application unit, the protective material being applied to one or two sides of the end section of the single paper web, winding up the end section of the single paper web so that the end section with the protective material forms at least one outer layer of the paper roll, and curing the protective material after the winding up thereby creating a single protective layer that covers the circumferential surface of the single paper roll.

2. The method according to claim 1, wherein the end section forms multiple outer layers of the paper roll when it is wound up to at least three outer layers.

3. The method according to claim 1, wherein the end section is wound up while the protective material is not yet fully cured, so that the protective material connects several outer layers of the single paper roll formed by the end section during curing.

4. The method according to claim 1, wherein the end section is so long that it forms multiple outer layers of the single paper roll when it is wound up to at least five outer layers.

5. The method according to claim 1, wherein the end section is so long that it forms multiple outer layers of the single paper roll when it is wound up to at least seven outer layers.

6. The method of claim 1, wherein the applying the protective material is applied to only to the end section of the single paper web.

7. The method of claim 6, wherein the end section of the paper web is at least three outer layers, wherein each of the outer layers represents one revolution of the single paper web.

8. The method of claim 1, wherein a mark is applied to the single paper web that forms a start of the end section such that once the mark has been detected, a control signal is generated such that the protective material is applied to the end section of the single paper web starting at the mark.

9. A method for producing an end side packaging for a paper roll, the paper roll having a wound paper web and two opposing end faces and a circumferential surface that connects the end faces to each other, the method comprising the following steps:

providing an end cover that comprises a base body with an opening and a tab for covering the opening, the base body and the tab being designed as a single piece, arranging the end cover on a shaft in such a way that the end cover rests on an end side of the paper roll and the shaft extends through the opening, removing the paper roll from the shaft, and covering the opening with the tab.

10. The method according to claim 9, wherein the end cover is put on the shaft before the paper web is rolled up.

11. The method according to claim 9, wherein the opening is an indentation and the end cover is slid onto the shaft.

12. The method according to claim 11, wherein the tab has a first part for covering a first part of the indentation and a second part for covering a second part of the indentation, the first part of the indentation being covered by the first part of the tab before the paper roll is removed from the shaft.

13. The method according to claim 9, wherein the tab is connected to the base body across at least part of its circumference along a parting line, which has a perforation, wherein the tab has to be separated from the base body along the parting line before the end cover is slid onto the shaft.

14. The method according to claim 9, wherein the base body and the tab are produced from a paper material or cardboard material coated with a protective material.

15. A method for producing a packaging for a paper roll, the paper roll having a wound paper web and two opposing end faces and a circumferential surface that connects the end faces to each other, the method comprising the following steps:

producing a circumferential packaging comprising:

applying a protective material in liquid form to an end section of the paper web by means of at least one application unit, the protective material being applied to one or two sides of the end section of the paper web, winding up the end section of the paper web so that the end section forms at least one outer layer of the paper roll, and curing the protective material thereby creating a protective layer that covers the circumferential surface, producing an end side packaging comprising:

providing an end cover that comprises a base body with an opening and a tab for covering the opening, the base body and the tab being designed as a single piece, arranging the end cover on a shaft in such a way that the end cover rests on an end side of the paper roll and the shaft extends through the opening, removing the paper roll from the shaft, and covering the opening with the tab, and connecting the at least one end side packaging to the circumferential packaging.

16. The method according to claim 15, wherein two end side packagings are produced for one of the two end sides of the paper roll in each case.

17. The method according to claim 15, wherein the protective material for the circumferential packaging and the protective material for the at least one end side packaging are identical.

18. The method according to claim 15, wherein a diameter of at least one end cover is greater than the diameter of the paper roll and part of the end cover is turned down to connect the end side packaging to the circumferential packaging.

19. The method according to claim 15, wherein an edge protector is applied along the edges of the paper roll along which the circumferential surface adjoins the end sides after the circumferential packaging has been connected to the at least one end side packaging or to connect the circumferential packaging to the end side packaging.

* * * * *